US010238224B1

(12) United States Patent
Nazarian

(10) Patent No.: US 10,238,224 B1
(45) Date of Patent: Mar. 26, 2019

(54) ERGONOMIC CUP HOLDER WITH ENHANCED STABILITY AND WEIGHT DISTRIBUTION

(71) Applicant: THUMBZ INC., Montrose, CA (US)

(72) Inventor: Henrik Nazarian, Montrose, CA (US)

(73) Assignee: THUMBZ INC., Montrose, CA (US)

( * ) Notice: Subject to any disclaimer, the term of this patent is extended or adjusted under 35 U.S.C. 154(b) by 0 days.

(21) Appl. No.: 16/107,190

(22) Filed: Aug. 21, 2018

Related U.S. Application Data

(63) Continuation-in-part of application No. 15/604,561, filed on May 24, 2017, now abandoned.

(60) Provisional application No. 62/422,696, filed on Nov. 16, 2016.

(51) Int. Cl.
*B65D 1/36* (2006.01)
*A47G 23/02* (2006.01)
*A47G 23/06* (2006.01)

(52) U.S. Cl.
CPC ..... *A47G 23/0625* (2013.01); *A47G 23/0208* (2013.01); *B65D 1/36* (2013.01)

(58) Field of Classification Search
CPC ... A47G 23/0625; A47G 23/0208; B65D 1/36
USPC ..... 206/564, 562; 229/904, 407, 120.02, 229/120.22; 220/737, 556, 507, 738, 575, 220/574, 500
See application file for complete search history.

(56) References Cited

U.S. PATENT DOCUMENTS

| | | | | |
|---|---|---|---|---|
| 3,381,825 | A * | 5/1968 | Bessett | A47G 23/06 211/126.16 |
| 5,316,173 | A * | 5/1994 | Emery | A47G 23/0208 206/564 |
| 5,947,011 | A | 9/1999 | Xu | |
| 6,622,885 | B1 | 9/2003 | Erman | |
| 8,985,379 | B1 * | 3/2015 | Evans | A47J 45/00 206/562 |
| 2009/0211937 | A1 * | 8/2009 | Sharma | E06B 9/581 206/515 |
| 2011/0278187 | A1 * | 11/2011 | Yang | B65D 71/70 206/427 |
| 2014/0231438 | A1 | 8/2014 | Linneken | |

* cited by examiner

*Primary Examiner* — Jacob K Ackun
*Assistant Examiner* — Jenine Pagan
(74) *Attorney, Agent, or Firm* — Plager Schack LLP; Mark H. Plager; Eric Liou

(57) ABSTRACT

A cup holder storage apparatus with enhanced stability for securing a plurality of beverage storing cups is provided. The cup holder storage apparatus is designed to be supported by a user's thumb, index finger and radius bone in an arm. The apparatus includes a tray having a thumb hole in a central portion of the tray and a plurality of compartments, each compartment having an upper opening that receives one of the plurality of beverage storing cups, each compartment having a pair of arm members pivotably mounted to the upper opening of the compartment, and a pair of boomerang-shaped gutters coupled to each arm member and extending from a portion proximate the upper opening of the compartment to the bottom of the arm member.

20 Claims, 4 Drawing Sheets

ERGONOMIC CUP HOLDER WITH ENHANCED STABILITY AND WEIGHT DISTRIBUTION

RELATED APPLICATION

The application is a Continuation-in-Part of non-provisional patent application U.S. Ser. No. 15/604,561 filed on May 24, 2017, the entire contents of which is herein incorporated by reference. Non-provisional patent application U.S. Ser. No. 15/604,561 claims priority to provisional patent application U.S. Ser. No. 62/422,696 filed on Nov. 16, 2016, the entire contents of which is herein incorporated by reference.

BACKGROUND

The embodiments herein relate generally to cup holding trays and devices.

With the increasing consumption of gourmet coffees, lattes and other beverages, larger and bulkier take-out cups are being used to store these beverages. As a result, there is a growing need for a more reliable, comfortable and user-friendly cup-carrier to be used by the general public.

Existing cup-carriers or trays designed more than 20-30 years ago are outdated, unsafe, unreliable and are no longer satisfying the needs of users as a reliable cup-carrier that can accommodate today's larger and heavier cups and the fast moving lifestyle of individuals. Specifically, these cup carriers and trays are limited because they lack the desired depth to accommodate different-sized cups including larger and heavier cups. Further, these cup carriers do not provide proper designated hand holding areas to improve the balance and weight distribution of the carrier and any cups stored thereon. This makes it difficult to maneuver the carrier and results in the increased frequency of spillage due to tilted cups, monetary loss for shop owners for cup refills, and/or cleaning costs or burdens for individuals to remove beverage stains from their clothing.

Several other plates and trays for supporting cups and glasses are disclosed in U.S. Patent Application Publication 2014/0231438, and U.S. Pat. Nos. 5,947,011 and 6,622,885. However, these plates and trays are disadvantageous because they do not adjust to accommodate variable-sized cups including larger and heavier cups. In addition, these plates and trays do not effectively support the bottom of the cup and therefore require the user to manually grab and support the cup. As a result, these cup supporting devices require significant user effort to maintain the proper support, balance and weight distribution of the devices when in use.

As such, there is a need in the industry for an ergonomic cup holder storage apparatus that addresses the limitations of the prior art, which effectively accommodates different sized cups and enhances the stability, ease of use and weight distribution of the apparatus.

SUMMARY

A cup holder storage apparatus with enhanced stability for use in securing a plurality of beverage storing cups is provided. The cup holder storage apparatus is configured to be supported by a thumb, an index finger of a hand, and a radius bone in an arm of a user. The cup holder storage apparatus comprises a tray comprising a top surface, a bottom surface opposite the top surface, a thumb hole in a central portion of the tray and a plurality of compartments, each compartment in the plurality of compartments comprising an upper opening configured to receive one of the plurality of beverage storing cups, a plurality of identical arm members coupled to the tray, each compartment in the plurality of compartments comprising a pair of arm members in the plurality of identical arm members pivotably mounted to the upper opening of the compartment, each arm member in the pair of arm members comprising a bottom platform extending generally perpendicularly to a longitudinal axis of the arm member, the pair of arm members configured to pivotably adjust to conform to contours of the one of the plurality of beverage storing cups stored therein with the bottom platforms of the pair of arm members in contact with a bottom of the stored beverage storing cup, and a plurality of boomerang-shaped gutters coupled to the arm members in the plurality of identical arm members, a pair of boomerang-shaped gutters in the plurality of boomerang-shaped gutters coupled to each arm member in the plurality of identical arm members and extending from a portion proximate the upper opening of the compartment to the bottom platform of the arm member, the pair of boomerang-shaped gutters on each arm member in the plurality of arm members being separated by a distance that decreases from the portion proximate the upper opening to the bottom platform of the arm member, wherein the tray is configured to receive the thumb of the user through the thumb hole to permit the radius bone in the arm, thumb and index finger of the user to extend in space between the plurality of compartments and contact the bottom surface of the tray to support the cup holder storage apparatus and any of the plurality of beverage storing cups.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
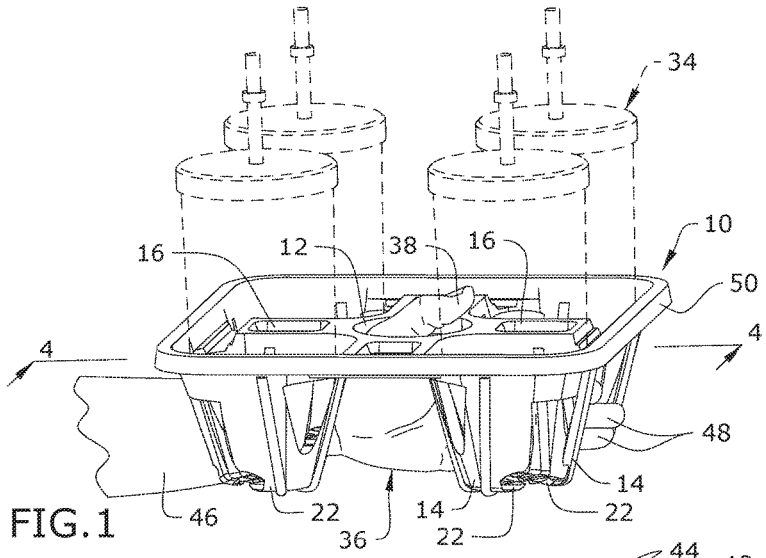
FIG. 1 depicts a perspective view of certain embodiments of the cup holder storage apparatus shown in use.
Figure 2:
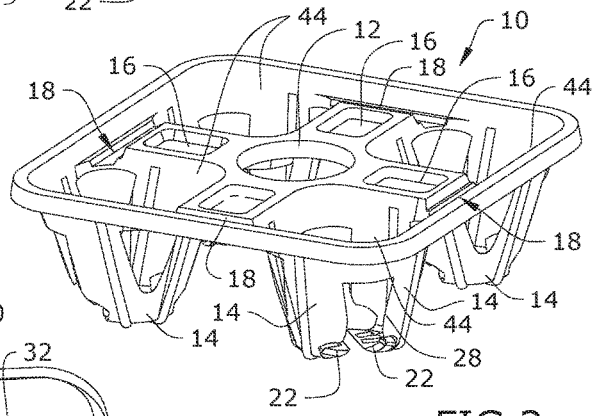
FIG. 2 depicts a top perspective view of certain embodiments of the cup holder storage apparatus.
Figure 3:
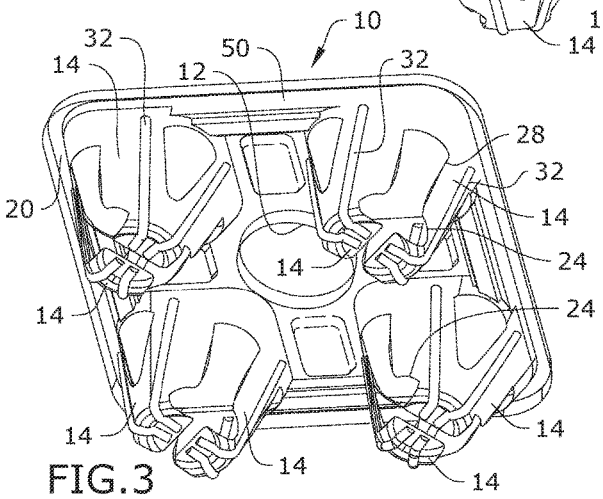
FIG. 3 depicts a bottom perspective view of certain embodiments of the cup holder storage apparatus.

As depicted in FIGS. 1-3, cup holder storage apparatus 10 is configured for use by an operator to support a plurality of cups 34. In certain embodiments, cups 34 store any beverage for consumption including, but not limited to, coffee, latte, tea, juice, smoothies, milk, and the like. Cup holder storage apparatus 10 is configured to be supported by arm 46 and hand 36 including thumb 38 and fingers 48 of the operator. As will become apparent in the following disclosure, cup holder storage apparatus 10 permits the operator to have a firm and comfortable holding position of the apparatus on the radius bone of arm 46, hand 36 and fingers 48. This enhances the balance, stability and weight distribution of cup holder storage apparatus 10 when the operator supports a plurality of cups 34.

In certain embodiments of the invention, the cup holder storage apparatus 10 generally comprises tray 50 and arm members 14. In a preferred embodiment, tray 50 is rectangular with approximate dimensions of 8⅜"×8⅛". However, alternate dimensions may be used. Cup holder storage apparatus 10 may be made from materials including, but not limited to, biodegradable disposable molded fibers, pulp, plastic, metal, wood or other materials. Tray 50 comprises central thumb hole 12 and a plurality of cup compartments formed by spacing created by upper openings 44 in tray 50 and arm members 14.

As depicted in FIGS. 2-5 and 7, a pair of arm members 14 are pivotably mounted to each upper opening 44 in tray 50 and oppositely oriented. Each arm member 14 comprises bottom platform 22, which is oriented generally perpendicular to the longitudinal axis of arm member 14. Arm member 14 comprises a pair of dome-shaped cutouts 24 on opposite sides of bottom platform 22.

In one embodiment, each arm member 14 comprises triangular-shaped opening 30 and a pair of boomerang-shaped gutters 32 coupled thereto. The pair of boomerang-shaped gutters 32 extend along arm member 14 from an upper location proximate upper opening 44 in tray 50 to bottom platform 22. In a preferred embodiment, boomerang-shaped gutters 32 are continuously connected to each arm member 14 as a single and continuous component. Each boomerang-shaped gutter 32 forms an indentation along the inner surface of arm member 14 and a protrusion along the outer surface of arm member 14. Boomerang-shaped gutters 32 enhance the strength of each pair of arm members 14 and prevent bottom platforms 22 from folding outward when supporting a larger and heavier cup 34.

Figure 5:
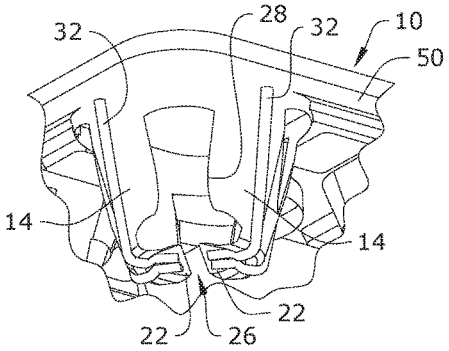
FIG. 5 depicts a bottom perspective view of certain embodiments of the cup holder storage apparatus shown without a cup.
Figure 7:
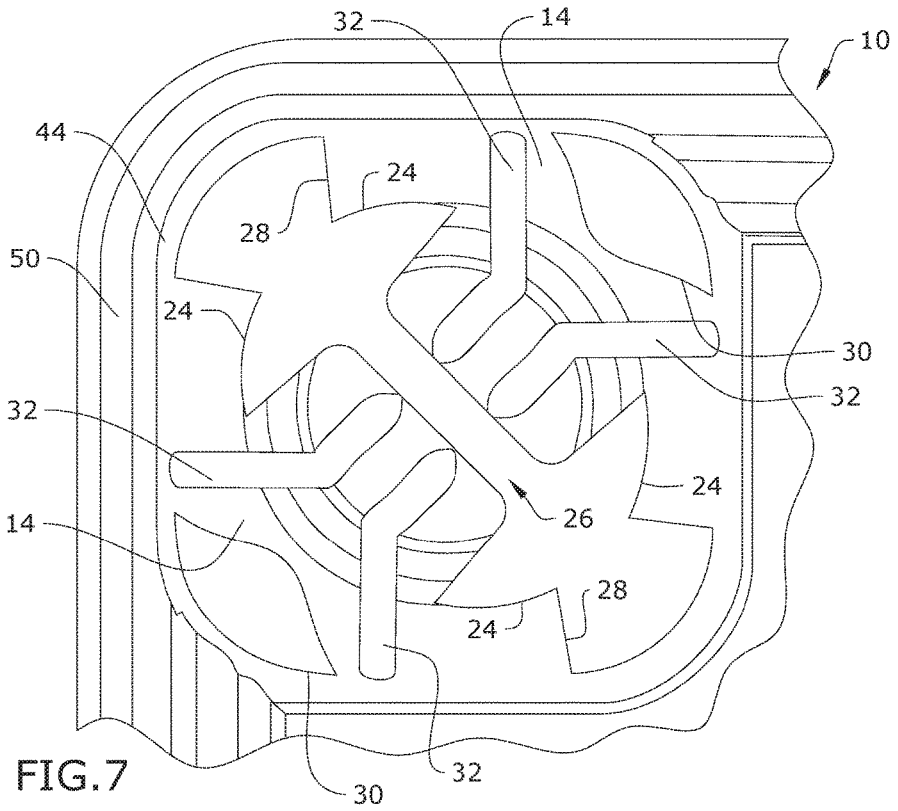
FIG. 7 depicts a top view of certain embodiments of the cup holder storage apparatus.

As depicted in FIGS. 5 and 7, in a resting configuration without cup 34 disposed within a cup compartment, each pair of arm members 14 is slanted relative to tray 50. Specifically, the distance between the pair of arm members 14 decreases from upper opening 44 of tray 50 to bottom platforms 22 of the pair of arm members 14. This is evident from the tapered shape of side cuts 28 between the pair of arm members 14. In one embodiment, the width of each side cut 28 decreases from approximately 1" wide at the top to approximately ½" wide at the bottom. This creates platform spacing 26 of approximately ¼" between the pair of bottom platforms 22 of arm members 14 in the resting configuration.

Figure 6:
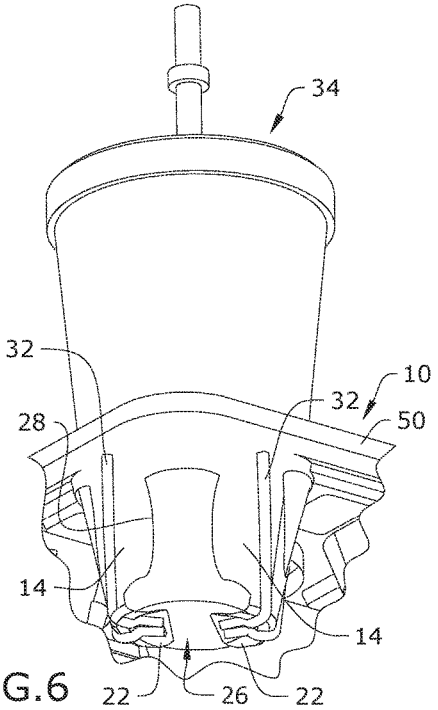
FIG. 6 depicts a bottom perspective view of certain embodiments of the cup holder storage apparatus shown with a cup.

Each pair of arm members 14 are configured to pivotably adjust outward to create an expandable space of approximately 2½" deep up to 3½" deep within the cup compartment. As depicted in FIG. 6, this permits the pair of arm members 14 to conform to contours of cup 34 stored therein with bottom platforms 22 of arm members 14 in contact with the bottom of cup 34. Cup holder storage apparatus 10 is advantageous because the pair of arm members 14 can accommodate different sized cups 34.

In a preferred embodiment, each upper opening 44 in tray 50 comprises a generally square shape with rounded corners. The square shape with rounded corners permit upper opening 44 to conform to cup 34 when disposed therethrough. In one embodiment, each side of the generally square shape of upper opening 44 is approximately 2¾". The cup compartment gradually tapers to a rounded cross-sectional shape toward bottom platforms 22 of the pair of arm members 14. Bottom platforms 22 prevent cup 34 from falling through the cup compartment and separating from cup holder storage apparatus 10. Bottom platforms 22 also create an evenly balanced base platform for cup holder storage apparatus 10 when disposed on a flat surface such as a table.

Dome-shaped cutouts 24 in arm members 14 allow for the release of pressure generated from the insertion of a larger-sized cup 34 within the cup compartment. Boomerang-shaped gutters 32 enhance the strength of each pair of arm members 14 and prevent bottom platforms 22 from folding outward when supporting a larger and heavier cup 34. Triangular-shaped openings 30 in arm members 14 further aid the expansion and pivotal movement of the arm members when accommodating cup 34.

In certain embodiments of the invention, tray 50 comprises a plurality of secondary storage compartments 16, multiple-layered gutters 18 extending along a top outer edge of tray 50, and continuous single-layered gutter 20 extending along a bottom outer edge of tray 50. In one embodiment, four secondary storage compartments 16 are positioned between upper openings 44 in tray 50 and comprise a rectangular shape. Secondary storage compartments 16 are configured to store condiments such as salt, pepper, sugar, spices, and the like, and enhance the strength of tray 50.

Figure 4:
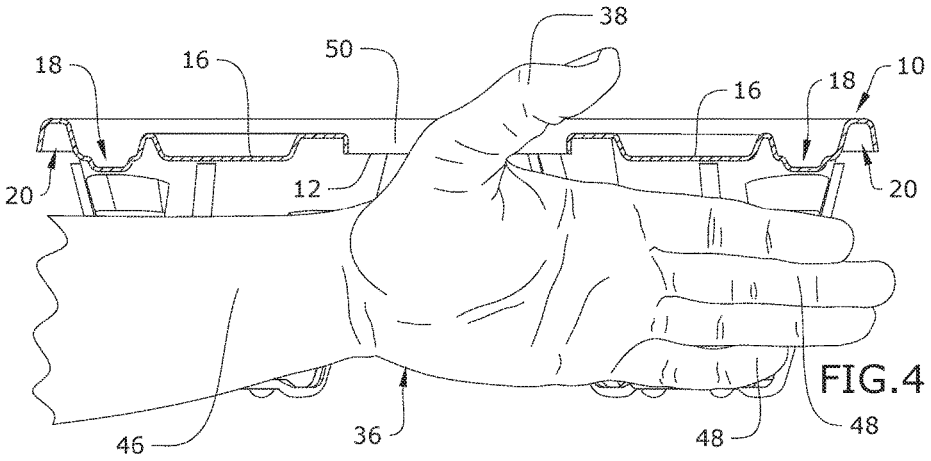
FIG. 4 depicts a section view of certain embodiments of the cup holder storage apparatus taken along line 4-4 in FIG. 1.
Figure 8:
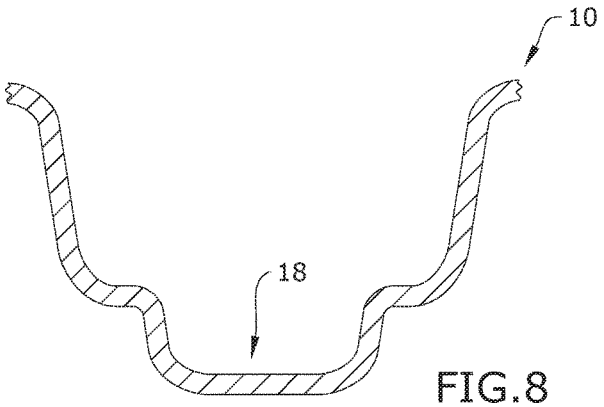
FIG. 8 depicts a section view of certain embodiments of the cup holder storage apparatus.

As depicted in FIGS. 2, 4 and 8, multiple-layered gutters 18 connect adjacent upper openings 44 of the cup compartments. In a preferred embodiment, each multiple-layered gutter 18 comprises three layers as depicted in FIG. 8. Multiple-layered gutters 18 enhance the strength of cup holder storage apparatus 10 and prevent tray 50 from bending when supporting the weight of one or more cups 34. As depicted in FIGS. 3-4, continuous single-layered gutter 20 extends along the entire bottom outer edge of tray 50. Continuous single-layered gutter 20 enhances the strength of cup holder storage apparatus 10 and prevents tray 50 from bending when in use.

In operation, one or more cups 34 are disposed within the cup compartments of cup holder storage apparatus 10 as depicted in FIG. 1. The pairs of arm members 14 pivotably adjust to accommodate cups 34 disposed therein. As depicted in FIGS. 1 and 4, the operator inserts thumb 38 from the bottom of tray 50 through central thumb hole 12. This permits thumb 38 to hold on the top of tray 50. Arm 46 and/or hand 36 including fingers 48 support the bottom of tray 50.

In one embodiment, tray 50 is configured to receive thumb 38 of the operator through central thumb hole 12 to permit the radius bone in arm 46, thumb 38 and index finger of the user to extend in space between the tray's cup compartments and contact the bottom surface of tray 50. It shall be appreciated that the cup holder storage apparatus 10 permits the operator's hand to be present in variable positions so that thumb 38 extends through central thumb hole 12 of tray 50 and fingers 48 extend radially from central thumb hole 12 through space between the cup compartments at any one of the 0, 90, 180 and 270 degree positions.

In one embodiment, the operator can support cup holder storage apparatus 10 and any cups 34 secured thereon with one hand and/or arm with enhanced balance, stability and weight distribution. In these positions, cup holder storage apparatus 10 is configured to secure cups 34 in place and minimize any spillage of the beverage contents.

Although fingers 48 generally wrap around a pair of arm members 14 in a supported and comfortable position, this is not required to support cup 34 disposed therein. It shall be appreciated that each pair of bottom platforms 22 of arm members 14 fully support any cup 34 stored thereon without the help of the operator.

Figure 9:
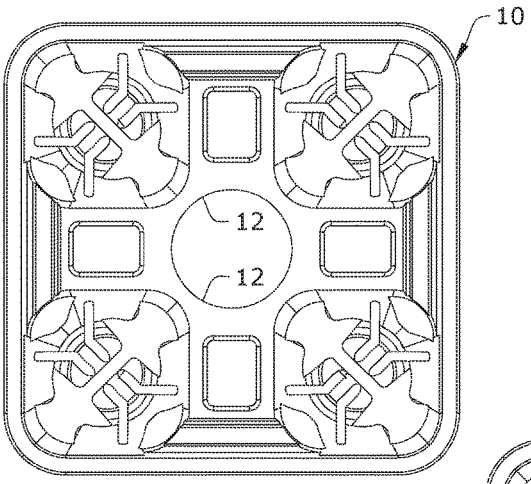
FIG. 9 depicts a top view of certain embodiments of the cup holder storage apparatus.
Figure 10:
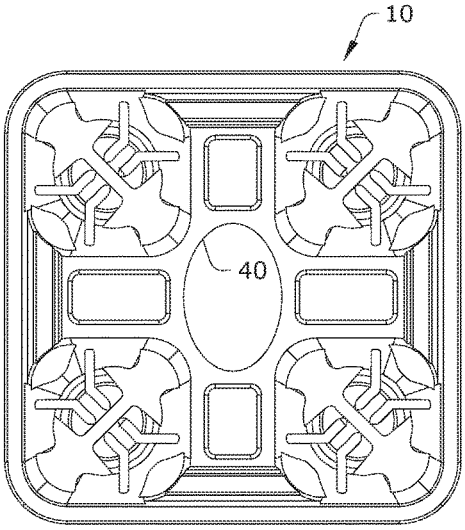
FIG. 10 depicts a top view of an alternate embodiment of the cup holder storage apparatus.
Figure 11:
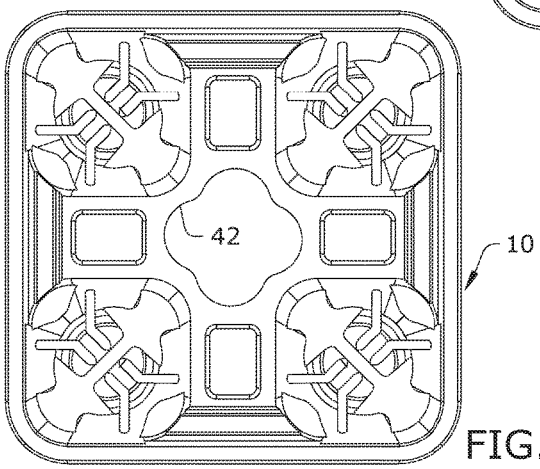
FIG. 11 depicts a top view of an alternate embodiment of the cup holder storage apparatus.

It shall be appreciated that central thumb hole 12 in tray 50 may have variable shapes and sizes to accommodate the operator. As depicted in FIGS. 2-3 and 9, central thumb hole 12 comprises a circular shape. As depicted in FIG. 10, alternate central thumb hole 40 comprises an elliptical shape. As depicted in FIG. 11, alternate central thumb hole 42 comprises a four-way shaped hole. In a preferred embodiment, the central thumb hole 12, 40, 42 is a symmetrical-shaped hole.

It shall be appreciated that the components of cup holder storage apparatus 10 described in several embodiments herein may comprise any alternative known materials in the field and be of any color, size and/or dimensions. It shall be appreciated that the components of cup holder storage apparatus 10 described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A cup holder storage apparatus with enhanced stability for use in securing a plurality of beverage storing cups, the cup holder storage apparatus configured to be supported by a thumb, fingers and a radius bone in an arm of a user, the cup holder storage apparatus comprising:

a tray comprising a top surface, a bottom surface opposite the top surface, a thumb hole in a central portion of the tray and a plurality of compartments, each compartment in the plurality of compartments comprising an upper opening configured to receive one of the plurality of beverage storing cups;

a plurality of identical arm members coupled to the tray, each compartment in the plurality of compartments comprising a pair of arm members in the plurality of identical arm members pivotably mounted to the upper opening of the compartment, each arm member in the pair of arm members comprising a bottom platform extending generally perpendicularly to a longitudinal axis of the arm member, the pair of arm members configured to pivotably adjust to conform to contours of the one of the plurality of beverage storing cups stored therein with the bottom platforms of the pair of arm members in contact with a bottom of the stored beverage storing cup; and a plurality of boomerang-shaped gutters coupled to the arm members in the plurality of identical arm members, a pair of boomerang-shaped gutters in the plurality of boomerang-shaped gutters coupled to each arm member in the plurality of identical arm members and extending from a portion proximate the upper opening of the compartment to the bottom platform of the arm member, the pair of boomerang-shaped gutters on each arm member in the plurality of arm members being separated by a distance that decreases from the portion proximate the upper opening to the bottom platform of the arm member;

wherein the tray is configured to receive the thumb of the user through the thumb hole to permit the thumb, fingers and arm of the user to support the cup holder storage apparatus.

2. The cup holder storage apparatus of claim 1, wherein the pair of arm members are oriented such that distance between the pair of arm members decreases from the upper opening of the compartment to the bottom platforms of the pair of arm members in a resting configuration without one of the plurality of beverage storing cups disposed therein.

3. The cup holder storage apparatus of claim 2, wherein each arm member in the plurality of arm members comprises a pair of domed-shaped cutouts on opposing sides of the bottom platform of the arm member.

4. The cup holder storage apparatus of claim 3, wherein each arm member in the plurality of arm members comprises a generally triangular-shaped opening.

5. The cup holder storage apparatus of claim 4, wherein the upper opening of each compartment in the plurality of compartments in the tray comprises a generally square shape with rounded corners.

6. The cup holder storage apparatus of claim 5, wherein the tray comprises a plurality of secondary storage compartments.

7. The cup holder storage apparatus of claim 6, wherein the tray further comprises a plurality of multiple-layered gutters extending along a top outer edge of the tray, each multiple-layered gutter connecting adjacent compartments in the plurality of compartments of the tray, wherein the plurality of multiple-layered gutters minimize bending of the tray when in use.

8. The cup holder storage apparatus of claim 7, further comprising a continuous single-layered gutter extending along a bottom outer edge of the tray.

9. The cup holder storage apparatus of claim 8, wherein the thumb hole in the tray comprises a symmetrical shape.

10. The cup holder storage apparatus of claim 9, wherein the tray is configured to permit the fingers of the user to extend radially from the thumb hole in the tray in space between a pair of adjacent compartments in the plurality of compartments in any one of the 0, 90, 180 and 270 degree positions.

11. A cup holder storage apparatus with enhanced stability for use in securing a plurality of beverage storing cups, the cup holder storage apparatus configured to be supported by a thumb, an index finger of a hand, and a radius bone in an arm of a user, the cup holder storage apparatus comprising:

a tray comprising a top surface, a bottom surface opposite the top surface, a thumb hole in a central portion of the tray and a plurality of compartments, each compartment in the plurality of compartments comprising an upper opening configured to receive one of the plurality of beverage storing cups;

a plurality of identical arm members coupled to the tray, each compartment in the plurality of compartments comprising a pair of arm members in the plurality of identical arm members pivotably mounted to the upper opening of the compartment, each arm member in the pair of arm members comprising a bottom platform extending generally perpendicularly to a longitudinal axis of the arm member, the pair of arm members configured to pivotably adjust to conform to contours of the one of the plurality of beverage storing cups stored therein with the bottom platforms of the pair of arm members in contact with a bottom of the stored beverage storing cup; and a plurality of boomerang-shaped gutters coupled to the arm members in the plurality of identical arm members, a pair of boomerang-shaped gutters in the plurality of boomerang-shaped gutters coupled to each arm member in the plurality of identical arm members and extending from a portion proximate the upper opening of the compartment to the bottom platform of the arm member, the pair of boomerang-shaped gutters on each arm member in the plurality of arm members being separated by a distance that decreases from the portion proximate the upper opening to the bottom platform of the arm member;

wherein the tray is configured to receive the thumb of the user through the thumb hole to permit the radius bone in the arm, thumb and index finger of the user to extend in space between the plurality of compartments and contact the bottom surface of the tray to support the cup holder storage apparatus and any of the plurality of beverage storing cups.

12. The cup holder storage apparatus of claim 11, wherein the pair of arm members are oriented such that distance between the pair of arm members decreases from the upper opening of the compartment to the bottom platforms of the pair of arm members in a resting configuration without one of the plurality of beverage storing cups disposed therein.

13. The cup holder storage apparatus of claim 12, wherein each arm member in the plurality of arm members comprises a pair of domed-shaped cutouts on opposing sides of the bottom platform of the arm member.

14. The cup holder storage apparatus of claim 13, wherein each arm member in the plurality of arm members comprises a generally triangular-shaped opening.

15. The cup holder storage apparatus of claim 14, wherein the upper opening of each compartment in the plurality of compartments in the tray comprises a generally square shape with rounded corners.

16. The cup holder storage apparatus of claim 15, wherein the tray comprises a plurality of secondary storage compartments.

17. The cup holder storage apparatus of claim 16, wherein the tray further comprises a plurality of multiple-layered gutters extending along a top outer edge of the tray, each multiple-layered gutter connecting adjacent compartments in the plurality of compartments of the tray, wherein the plurality of multiple-layered gutters minimize bending of the tray when in use.

18. The cup holder storage apparatus of claim 17, further comprising a continuous single-layered gutter extending along a bottom outer edge of the tray.

19. The cup holder storage apparatus of claim 18, wherein the thumb hole in the tray comprises a symmetrical shape.

20. The cup holder storage apparatus of claim 19, wherein the tray is configured to permit the index finger of the user to extend radially from the thumb hole in the tray in space between a pair of adjacent compartments in the plurality of compartments in any one of the 0, 90, 180 and 270 degree positions.

* * * * *